US009278518B2

(12) United States Patent
Fujii et al.

(10) Patent No.: US 9,278,518 B2
(45) Date of Patent: Mar. 8, 2016

(54) PRINTHEAD SUBSTRATE, PRINTHEAD, AND PRINTING APPARATUS

(71) Applicant: CANON KABUSHIKI KAISHA, Tokyo (JP)

(72) Inventors: Kazunari Fujii, Tokyo (JP); Masanobu Ohmura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/518,297

(22) Filed: Oct. 20, 2014

(65) Prior Publication Data

US 2015/0138279 A1 May 21, 2015

(30) Foreign Application Priority Data

Nov. 15, 2013 (JP) ..... 2013-237356

(51) Int. Cl.
*B41J 2/14* (2006.01)
*B41J 2/16* (2006.01)
*B41J 2/045* (2006.01)

(52) U.S. Cl.
CPC ..... *B41J 2/04541* (2013.01); *B41J 2/0458* (2013.01); *B41J 2/04543* (2013.01); *B41J 2/14072* (2013.01)

(58) Field of Classification Search
CPC ..... B41J 2/14072; B41J 2/14129; B41J 2002/14491; B41J 2/1433
USPC ..... 347/58, 50
See application file for complete search history.

(56) References Cited

U.S. PATENT DOCUMENTS 5,469,199 A * 11/1995 Allen et al. ..... 347/42
5,600,354 A * 2/1997 Hackleman ..... B41J 2/14024 347/50
2008/0129781 A1* 6/2008 Furukawa ..... 347/50
2008/0180490 A1* 7/2008 Murata ..... B41J 2/14233 347/70
2010/0220152 A1* 9/2010 Hayashi ..... B41J 2/14209 347/56
2011/0279548 A1* 11/2011 Yamamoto et al. ..... 347/54
2012/0274703 A1* 11/2012 Tsuchii et al. ..... 347/40
2012/0306968 A1* 12/2012 Benjamin ..... 347/40

FOREIGN PATENT DOCUMENTS

JP 2006-326972 A 12/2006

* cited by examiner

*Primary Examiner* — Matthew Luu
*Assistant Examiner* — Patrick King
(74) *Attorney, Agent, or Firm* — Fitzpatrick, Cella, Harper & Scinto

(57) ABSTRACT

A printhead substrate comprising a plurality of printing portions and a plurality of ink supply ports, wherein the plurality of printing portions are divided into a plurality of groups, and the plurality of ink supply ports are arranged so as to correspond to the plurality of groups respectively, the printhead substrate also comprises a plurality of first voltage wiring portions provided in correspondence with the plurality of groups, and each first voltage wiring portion includes a first wiring pattern configured to connect the first terminals of the respective printing portions in the corresponding group with each other, and a second wiring pattern connected to the first wiring pattern and arranged between an ink supply port in the corresponding group and its neighboring ink supply port.

19 Claims, 9 Drawing Sheets

PRINTHEAD SUBSTRATE, PRINTHEAD, AND PRINTING APPARATUS

BACKGROUND OF THE INVENTION

1. Field of the Invention

The present invention relates to a printhead substrate, a printhead, and a printing apparatus.

2. Description of the Related Art

A printing apparatus typified by a printer or the like prints by conveying a printing medium in a direction intersecting a scanning direction while scanning a printhead. The printhead includes a substrate (printhead substrate) on which printing elements such as electrothermal transducers (heaters) are arrayed.

A power supply voltage for driving each printing element is supplied onto the printhead substrate. For example, a power supply wiring (VH) and a ground wiring (GND) can be arranged respectively along the array direction of the printing elements. When printing, the more the number of printing elements to be driven concurrently, the more significant a drop in the power supply voltage.

Japanese Patent Laid-Open No. 2006-326972 discloses a structure in which the power supply wiring arranged along the array direction of the printing elements is connected to an electrode pad arranged at one end of the printhead substrate, and the ground wiring arranged along the array direction is connected to an electrode pad arranged at the other end of the printhead substrate. The power supply wiring and the ground wiring are arranged along the array direction of the printing elements. According to the structure disclosed in Japanese Patent Laid-Open No. 2006-326972, a difference in drop amounts in the power supply voltage between the respective printing elements is reduced.

As one method of increasing a printing speed, the number of printing elements to be driven at once is increased. As described above, however, the more the number of printing elements to be driven concurrently, the more significant the drop in the power supply voltage. Therefore, in order to increase the printing speed, it is necessary to increase the number of printing elements to be driven, and at the same time to prevent the drop in the power supply voltage resulting from this.

As one method of preventing the drop in the power supply voltage, the plurality of printing elements are divided into several groups, and the power supply voltages are supplied to the plurality of printing elements individually for each group. In the structure disclosed in Japanese Patent Laid-Open No. 2006-326972, a voltage is supplied from the power supply wiring (or the ground wiring) arranged along the array direction of the printing elements to each printing element. This makes it difficult to provide a path for supplying the power supply voltage for each group.

SUMMARY OF THE INVENTION

The present invention provides a technique advantageous in, on a printhead substrate, dividing a plurality of printing elements into a plurality of groups, and supplying power supply voltages to the plurality of printing elements individually for each group.

One of the aspects of the present invention provides a printhead substrate comprising a plurality of printing portions and a plurality of ink supply ports, wherein the plurality of printing portions are divided into a plurality of groups arrayed along a first direction, the plurality of ink supply ports are arranged along the first direction so as to correspond to the plurality of groups respectively, the printhead substrate comprises a plurality of first voltage wiring portions provided in correspondence with the plurality of groups and configured to respectively supply a first voltage to first terminals of the printing portions in corresponding groups of the plurality of groups, and one of the plurality of first voltage wiring portions includes a first wiring pattern configured to electrically connect the first terminals of the printing portions in the corresponding group with each other, and a second wiring pattern arranged between an ink supply port in the corresponding group and another ink supply port different from the ink supply port in the corresponding group, and electrically connected to the first wiring pattern.

Further features of the present invention will become apparent from the following description of exemplary embodiments with reference to the attached drawings.

DESCRIPTION OF THE EMBODIMENTS

Example of Arrangement of Printing Apparatus

Figure 1:
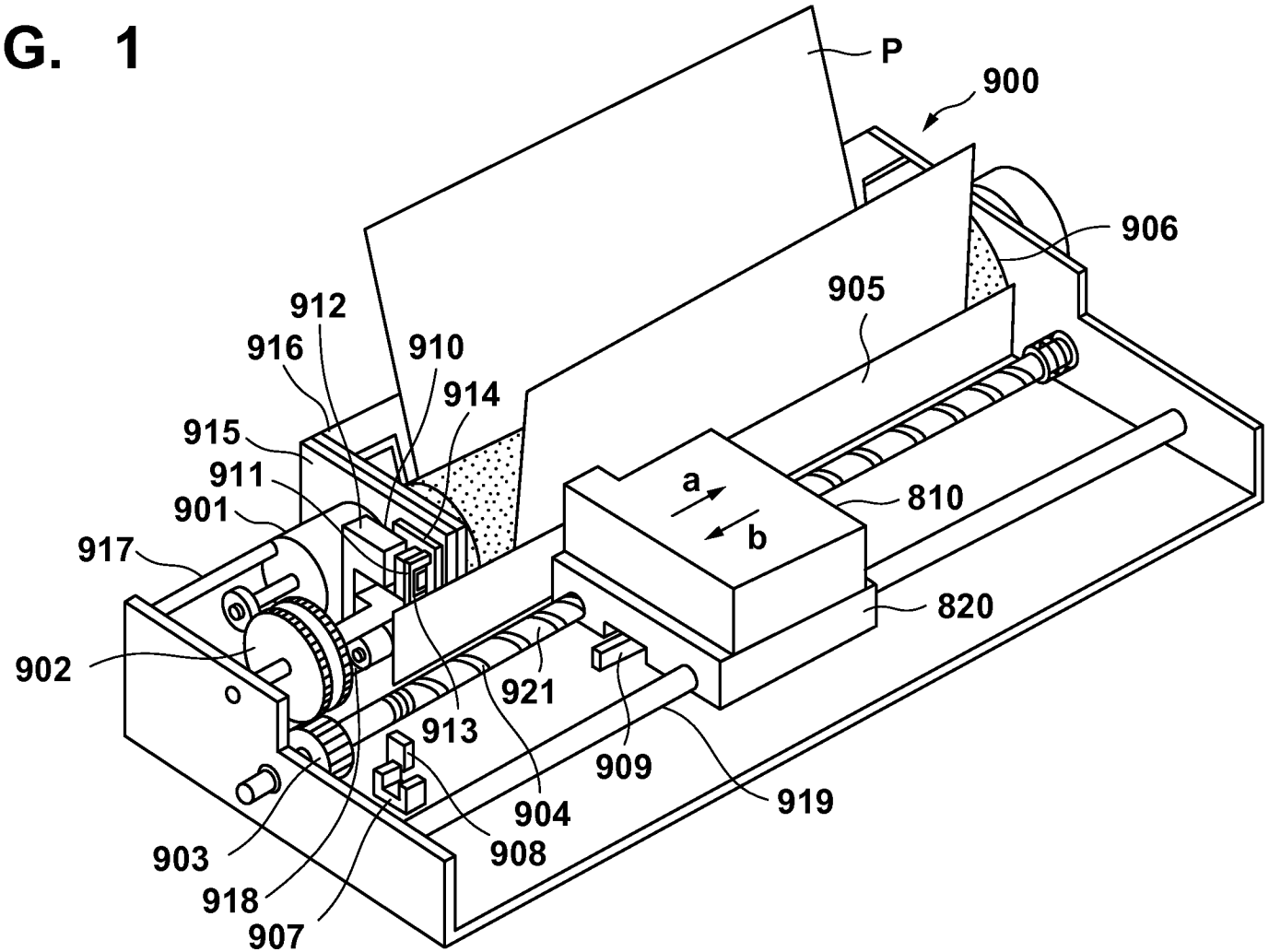
FIG. 1 is a view for explaining an example of the internal arrangement of a printing apparatus.

FIG. 1 exemplifies the internal arrangement of an inkjet printing apparatus 900 typified by a printer, facsimile apparatus, copying machine, or the like. The printing apparatus 900 includes a printhead 810 which discharges ink (printing material) to a printing medium P such as a printing sheet. The printhead 810 can be mounted on a carriage 820, and the carriage 820 can be attached to a lead screw 921 having a helical groove 904. The lead screw 921 can rotate in synchronism with rotation of a driving motor 901 via driving force transfer gears 902 and 903. The printhead 810 can move in a direction indicated by an arrow a or b along a guide 919 together with the carriage 820.

A printing medium P is pressed by a paper press plate 905 in a carriage moving direction, and fixed to a platen 906. The printing apparatus 900 reciprocally moves the printhead 810 to print on the printing medium P conveyed on the platen 906 by a conveyance unit (not shown).

The printing apparatus 900 checks, via photocouplers 907 and 908, the position of a lever 909 arranged on the carriage 820, and switches the rotational direction of the driving motor 901. A support member 910 supports a cap member 911 for capping the ink orifices (nozzles) of the printhead 810. A suction means 912 performs recovery processing of the printhead 810 by sucking the inside of the cap member 911 via an intra-cap opening 913. A lever 917 is arranged to start recovery processing by suction. The lever 917 moves along with movement of a cam 918 engaged with the carriage 820, and a driving force from the driving motor 901 is controlled by a known transfer means such as clutch switching.

A main body support plate 916 supports a moving member 915 and a cleaning blade 914. The moving member 915 moves the cleaning blade 914 to perform recovery processing of the printhead 810 by wiping. The printing apparatus 900 includes a printing control unit (not shown), and the printing control unit controls driving of each mechanism described above.

Example of Arrangement of Printhead

Figure 2:
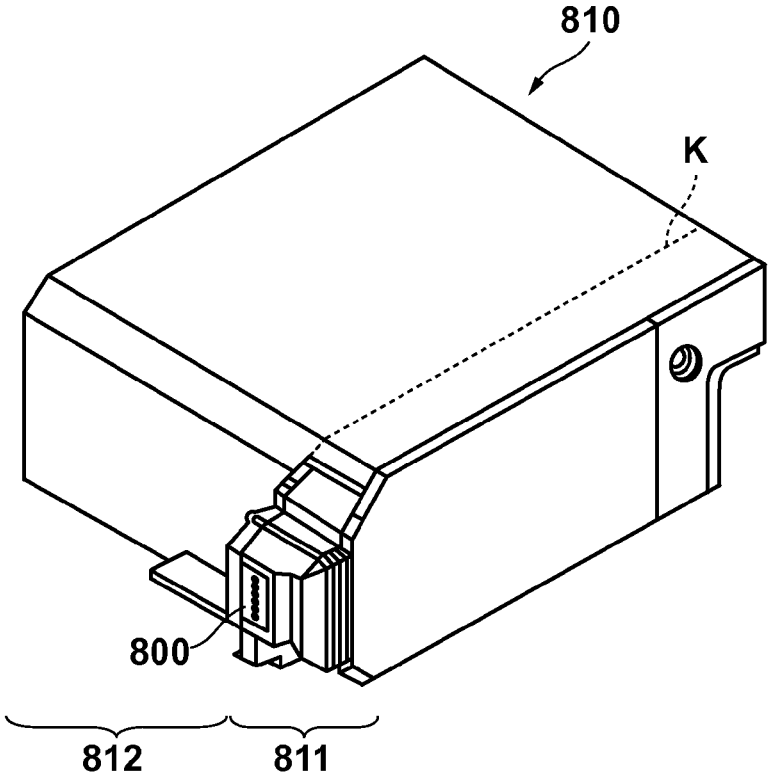
FIG. 2 is a view for explaining an example of the arrangement of a printhead.

FIG. 2 exemplifies the outer appearance of the printhead 810. The printhead 810 can include a printhead unit 811 including a plurality of nozzles 800, and an ink tank 812 which holds ink to be supplied to the printhead unit 811. The ink tank 812 and the printhead unit 811 can be separated at, for example, a broken line K, and the ink tank 812 is exchangeable. The printhead 810 includes an electrical contact (not shown) for receiving an electrical signal from the carriage 820, and performs the above-described printing by discharging ink in accordance with the electrical signal. The ink tank 812 includes, for example, a fibrous or porous ink holding member (not shown), and the ink holding member can hold ink.

Figure 3:
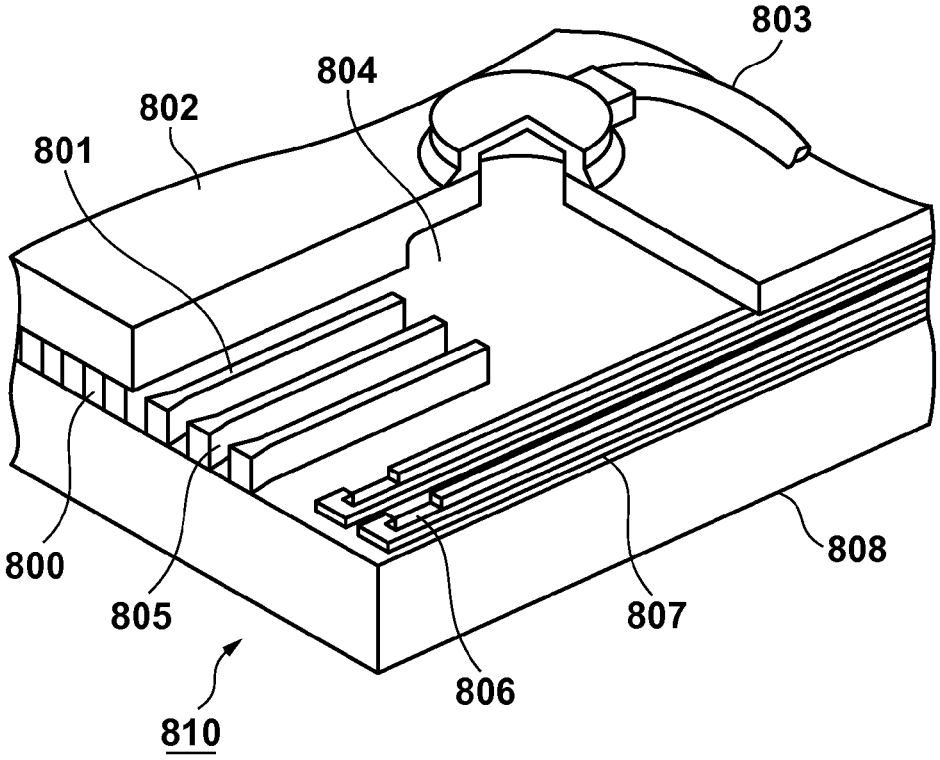
FIG. 3 is a view for explaining an example of the internal arrangement of the printhead.

FIG. 3 exemplifies the internal arrangement of the printhead 810. The printhead 810 includes a substrate 808, an ink flow path wall members 801 which are arranged on the substrate 808 to form ink flow paths 805, and a top plate 802 including an ink supply path 803. As printing elements, heaters 806 (electrothermal transducers) are arrayed in correspondence with the respective nozzles 800 on the printhead substrate of the printhead 810. When a driving element (transistor) arranged in correspondence with each heater 806 is changed to the conductive state and driven, the heater 806 generates heat.

Ink from the ink supply path 803 is stored in a common ink chamber 804 and supplied to each nozzle 800 via each ink flow path 805. The ink supplied to each nozzle 800 is discharged from the nozzle 800 in response to driving the heater 806 corresponding to each nozzle 800.

System Arrangement

Figure 4:
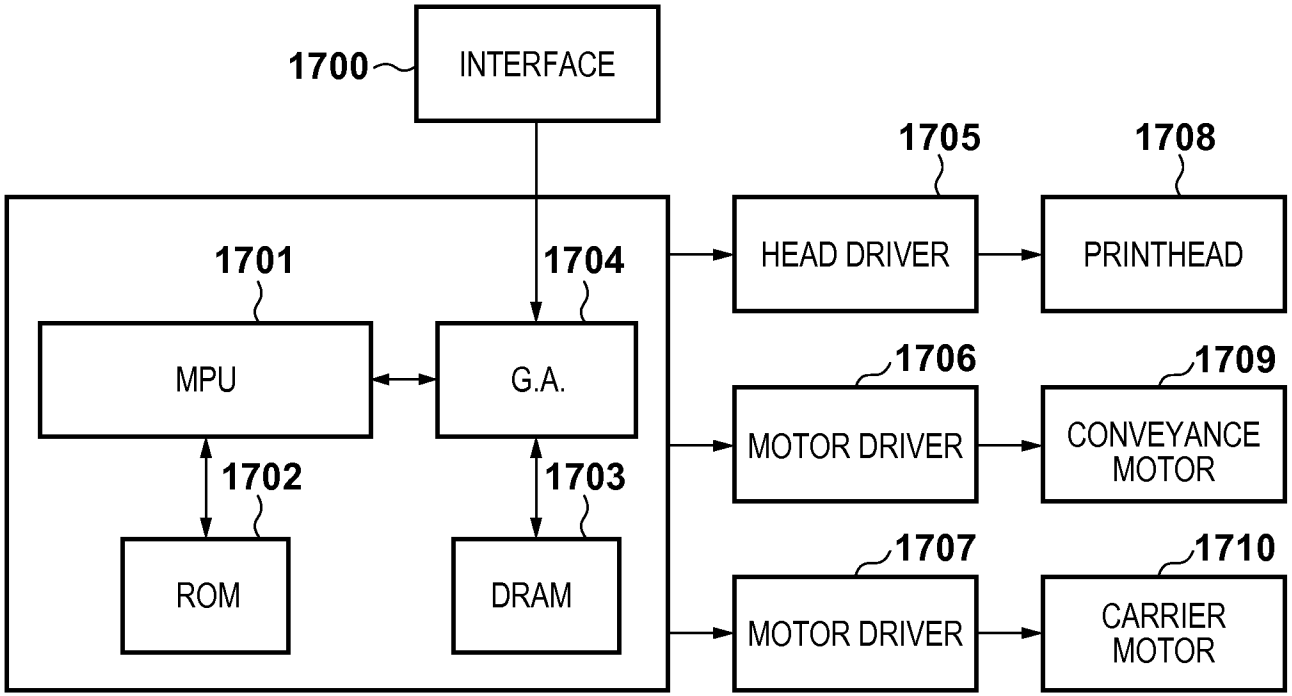
FIG. 4 is a block diagram for explaining an example of the system arrangement of the printing apparatus.

FIG. 4 exemplifies the system arrangement of the printing apparatus 900. The printing apparatus 900 includes an interface 1700, an MPU 1701, a ROM 1702, a RAM 1703, and a gate array 1704. The interface 1700 receives a print signal. The ROM 1702 stores a control program to be executed by the MPU 1701. The RAM 1703 saves various data such as the aforementioned print signal, and print data supplied to a printhead 1708. The gate array 1704 controls supply of print data to the printhead 1708, and also controls data transfer between the interface 1700, the MPU 1701, and the RAM 1703.

The printing apparatus 900 further includes a printhead driver 1705, motor drivers 1706 and 1707, a conveyance motor 1709, and a carrier motor 1710. The carrier motor 1710 conveys the printhead 1708. The conveyance motor 1709 conveys a printing medium P. The printhead driver 1705 drives the printhead 1708. The motor drivers 1706 and 1707 drive the conveyance motor 1709 and the carrier motor 1710, respectively.

When a print signal is input to the interface 1700, it can be converted into print data for printing between the gate array 1704 and the MPU 1701. Each mechanism performs a desired operation in accordance with the print data, thus performing the above-described printing.

First Embodiment

Figure 5A:
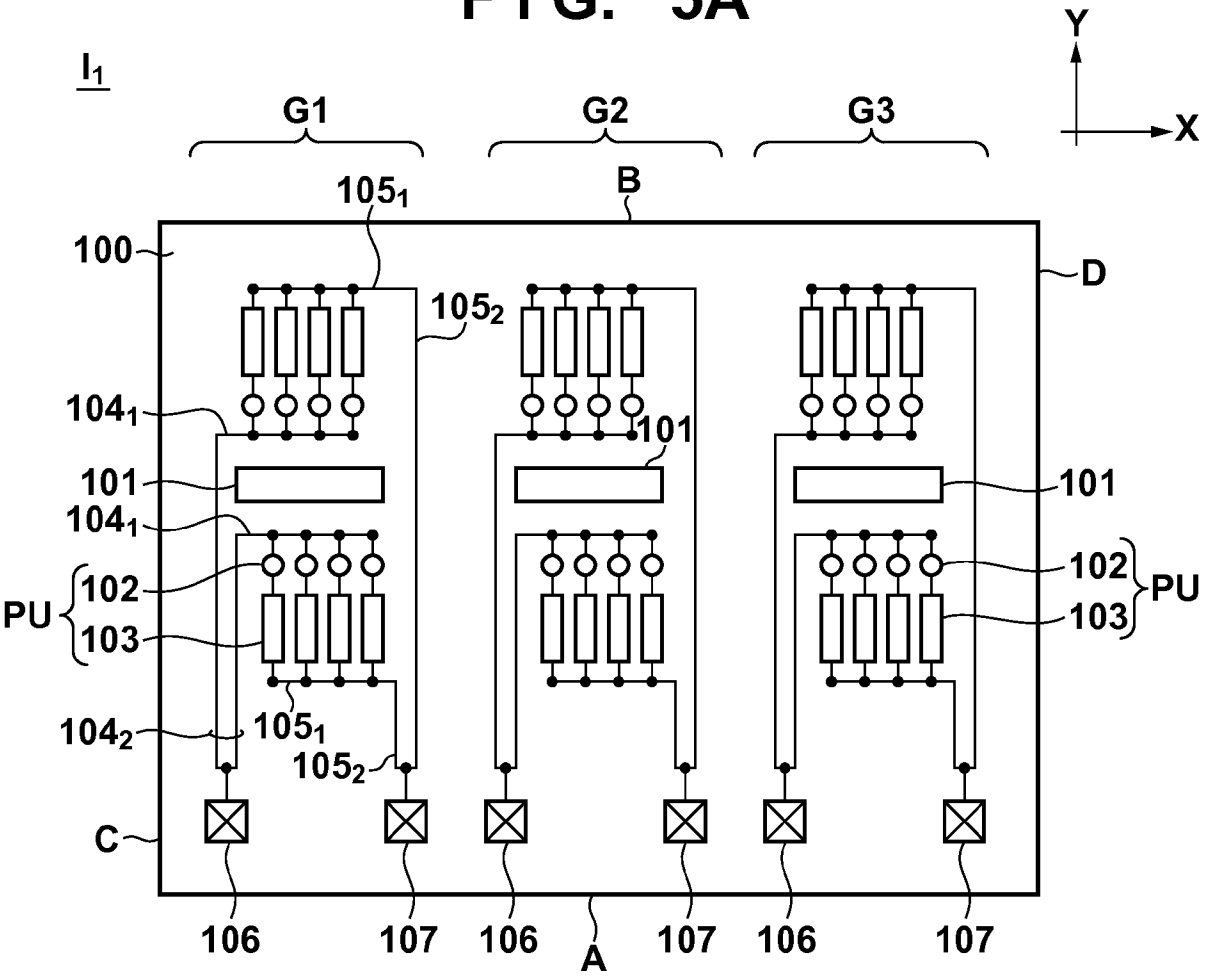
FIGS. 5A and 5B are diagrams for explaining examples of the arrangement of a printhead substrate.

The first embodiment will be described with reference to FIGS. 5A and 5B. FIG. 5A is a schematic diagram showing an example of the arrangement of a printhead substrate $I_1$ according to this embodiment. The printhead substrate $I_1$ includes a plurality of printing portions PU which are formed on a substrate 100 made of a semiconductor such as silicon, and a plurality of ink supply portions 101 (ink supply ports) configured to supply ink to the respective printing portions PU. The plurality of printing portions PU are arrayed along an X direction in FIG. 5A. Each printing portion PU includes a printing element 102 configured to print, and a driving element 103 configured to drive the printing element 102. Each ink supply portion 101 includes an opening formed to penetrate, assuming that the printing portion PU is formed on the front side of the substrate 100, from the front side to the back side of the substrate 100, and connects or corresponds to the aforementioned ink flow path 805.

Figure 5B:
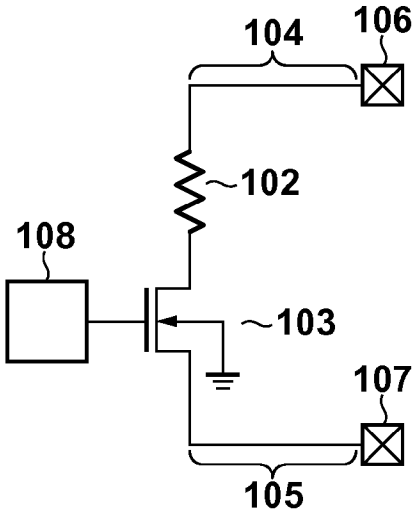

FIG. 5B is a circuit diagram showing an example of the arrangement of each printing portion PU. As shown in FIG. 5B, the printing element 102 can use a heater which generates heat energy upon being driven, and the driving element 103 can use an NMOS transistor configured to drive the printing element 102. The printing element 102 and the driving element 103 are arranged in series, and can form a current path. The printing element 102 is electrically connected, via a power supply wiring portion 104, to an electrode pad 106 configured to receive a power supply voltage VH. On the other hand, the driving element 103 is electrically connected to a ground (GNDH) electrode pad 107 via a power supply wiring portion 105. With this arrangement, a power supply voltage is supplied to each printing portion PU. When the driving element 103 is changed to the conductive state upon receiving, for example, a control signal from a control unit 108 in a control terminal (gate terminal), the heater serving as the printing element 102 generates heat. Note that the arrangement of the printing portion PU shown in FIG. 5B is merely an example. The printing portion PU may adopt another arrangement and use, for example, a PMOS transistor or another switching element.

As shown in FIG. 5A, the printing portions PU are divided into a plurality of groups G (G1, G2, and G3 in FIG. 5A). In each group G, the printing portions PU are arrayed in, for example, two columns.

These two columns are formed to shift from each other in the X direction. That is, letting P be an array spacing between the printing portions PU (a pitch between the printing portions PU in the X direction), one column of two columns is arranged to shift from the other column by a P/2-distance. In a printing operation, since the printhead including the printhead substrate $I_1$ is scanned in a Y direction intersecting the X direction, the two columns are formed to shift from each other. Accordingly, dots are formed on a printing medium with a P/2-pitch.

Note that the arrangement in which each group G includes 4 (2 (columns)×4 (rows)=8 in total) printing portions PU per one column has been exemplified here, for the descriptive simplicity. However, the number of portions PU is not limited to this.

The plurality of ink supply portions 101 correspond to the plurality of groups G, respectively. The respective ink supply portions 101 are arranged along the X direction, and each of them is arranged between the two-column printing portions PU of the corresponding group G.

The respective sides of the printhead substrate $I_1$ indicate a side A, a side B, a side C, and a side D. The printhead substrate $I_1$ further includes the plurality of pads 106 and 107 corresponding to the plurality of groups G, respectively. The respective pads 106 and 107 are arranged along the X direction in the vicinity of the side A. In FIG. 5A, the arrangement in which the respective pads 106 and 107 are arranged in the vicinity of the side A is exemplified. However, they may be arranged in the vicinity of one of the remaining sides (the side B, here).

In each printing portion PU, the printing element 102 is arranged on a side closer to the ink supply portion 101, and the driving element 103 is arranged on the opposite side (on the side of the side A or the side B). For example, in one column on the side of the side A of the two-column printing portions PU in the first group G1, the printing elements 102 are positioned on the side of the side B, and the driving elements 103 are positioned on the side of the side A. On the other hand, for example, in one column on the side of the side B of the two-column printing portions PU in the first group G1, the printing elements 102 are positioned on the side of the side A, and the driving elements 103 are positioned on the side of the side B.

The power supply wiring portions (or voltage wiring portions) 104 and 105 are arranged in correspondence with the above-described two columns, respectively. Each power supply wiring portion 104 includes a wiring pattern $\mathbf{104}_1$ and a wiring pattern $\mathbf{104}_2$. The wiring patterns $\mathbf{104}_1$ are arranged along the X direction, and electrically connected to the printing elements 102. The wiring patterns $\mathbf{104}_2$ are arranged along the Y direction, and electrically connected to the wiring patterns $\mathbf{104}_1$ on the side of the side C and also electrically connected to the pads 106.

Similarly, each power supply wiring portion 105 includes a wiring pattern $\mathbf{105}_1$ and a wiring pattern $\mathbf{105}_2$. The wiring patterns $\mathbf{105}_1$ are arranged along the X direction, and electrically connected to the driving elements 103. The wiring patterns $\mathbf{105}_2$ are arranged along the Y direction, and electrically connected to the wiring patterns $\mathbf{105}_1$ on the side of the side D and also electrically connected to the pads 107.

Note that the wiring patterns $\mathbf{104}_2$ and $\mathbf{105}_2$ corresponding to one column on the side of the side B of the above-described two columns are arranged to pass through the vicinity of the corresponding ink supply portion 101 (the vicinity of the short side of the rectangular-shaped ink supply portion 101, here).

According to the above arrangement, between the individual printing portions PU in each of the above-described two columns, the sum of a resistance component by the power supply wiring portions 104 and that by the power supply wiring portions 105 becomes nearly equal to one another. For example, when focusing on one column on the side of the side A of two columns in the first group G1, a wiring resistance by the wiring pattern $\mathbf{104}_1$ to the printing portions PU on the side of the side C is lower than that on the side of the side D. On the other hand, a wiring resistance by the wiring pattern $\mathbf{105}_1$ to the printing portions PU on the side of the side C is higher than that on the side of the side D. As a result, a difference in potential fluctuation in the individual printing portions PU, that is, a difference in voltage drop between the printing portions PU can be reduced in the one column. The same applies to one column on the side of the side B of two columns in the first group G1.

The above also applies to other groups (the second group G2 and the third group G3). Note that in each group G, two wiring patterns $\mathbf{104}_2$ ($\mathbf{105}_2$) connected to the corresponding pad 106 (107) may be formed by one wiring pattern.

The control unit 108 controls two or more printing elements 102 not to be driven in each group G or each column of two columns in each group G. By doing so, a voltage drop amount caused by an increase in the number of printing elements 102 to be driven concurrently becomes almost constant, thereby reducing a variation in printing characteristics. This control is applied to, for example, a printing method by time-divisional driving.

The above arrangement is advantageous in grouping the plurality of printing portions PU, and can also supply power supply voltages individually to the respective groups G. This makes it possible to suppress a drop in the power supply voltage.

In this embodiment, the arrangement including three groups G1 to G3 and three ink supply portions 101 corresponding to them respectively, and the arrangement of the power supply wiring portions in the above arrangement have been exemplified. However, the numbers and the arrangements are not limited to these. The numbers of groups G and ink supply portions 101 may be, for example, four or more, and the printing portions PU in each group G may be arranged, for example, not in two columns but in one column, or in three or more columns. It is possible to increase the printing speed by increasing these numbers. Adopting the arrangement exemplified in this embodiment is advantageous in grouping the printing portions PU, and can suppress the drop in the power supply voltage in each group G.

Second Embodiment

Figure 6:
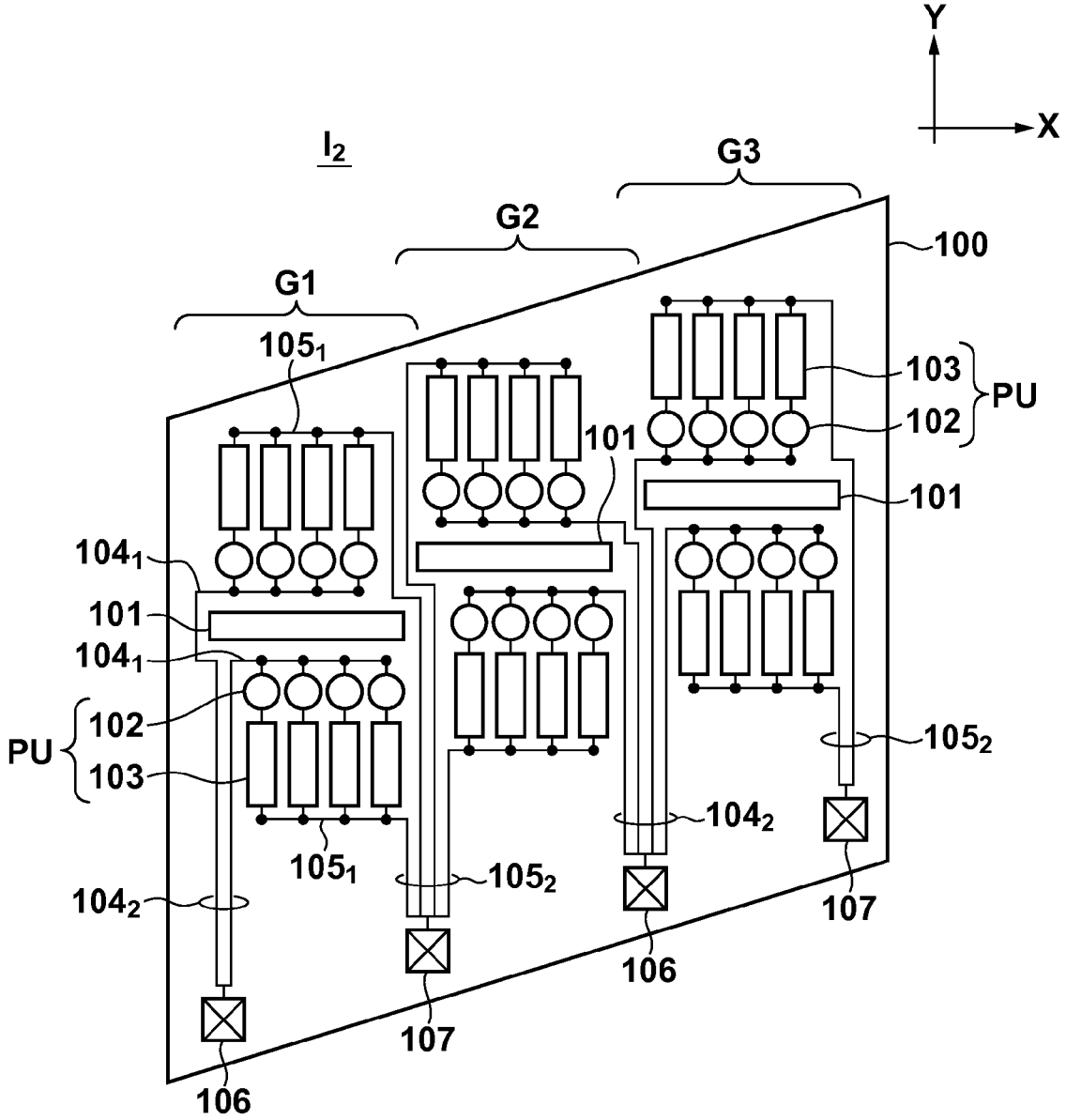
FIG. 6 is a diagram for explaining an example of the arrangement of a printhead substrate.

The second embodiment will be described with reference to FIG. 6. FIG. 6 is a schematic diagram showing an example of the arrangement of a printhead substrate $I_2$ according to this embodiment. This embodiment is different from the aforementioned first embodiment in that a plurality of printing portions PU are arranged to shift in a Y direction for each group G. To match this arrangement, the printhead substrate $I_2$ may have a parallelogram shape. Likewise, an ink supply portion 101 corresponding to each group G is formed to shift in the Y direction.

According to this arrangement, it is possible to make a spacing of the printing portions PU between the adjacent groups G in an X direction smaller than that in the first embodiment while arranging wiring patterns $\mathbf{104}_2$ and $\mathbf{105}_2$ to pass through between the respective ink supply portions 101.

That is, a distance in the X direction between two adjacent ink supply portions 101 is smaller than that in the first embodiment. This makes it possible, when printing, to form dots on a printing medium so as not to form spaces resulting from distances between the respective groups G. In addition, since the two ink supply portions 101 shift from each other in the Y direction, the wiring patterns $\mathbf{104}_2$ and $\mathbf{105}_2$ can be arranged between them.

In this embodiment, a group G1 and a group G2 share a GNDH pad 107, the group G2 and a group G3 share a VH pad 106, and four pads 106 and 107 are provided in total. That is, in the aforementioned first embodiment (FIG. 5A), the respective groups G1 to G3 have their own pads 106 and 107

(six pads 106 and 107 in total). According to this arrangement, however, it is also possible to reduce the number of pads.

Note that four wiring patterns $\mathbf{105}_2$ connected to the pad 107 corresponding to the groups G1 and G2 may be formed by one wiring pattern. The same applies to four wiring patterns $\mathbf{104}_2$ connected to the pad 106 corresponding to the groups G2 and G3.

The above arrangement can form, in addition to obtaining the same effect as in the first embodiment, the dots on the printing medium so as not to form the spaces resulting from the distances between the respective groups G when printing, and is also advantageous in improving the quality of a printing product.

Third Embodiment

Figure 7:
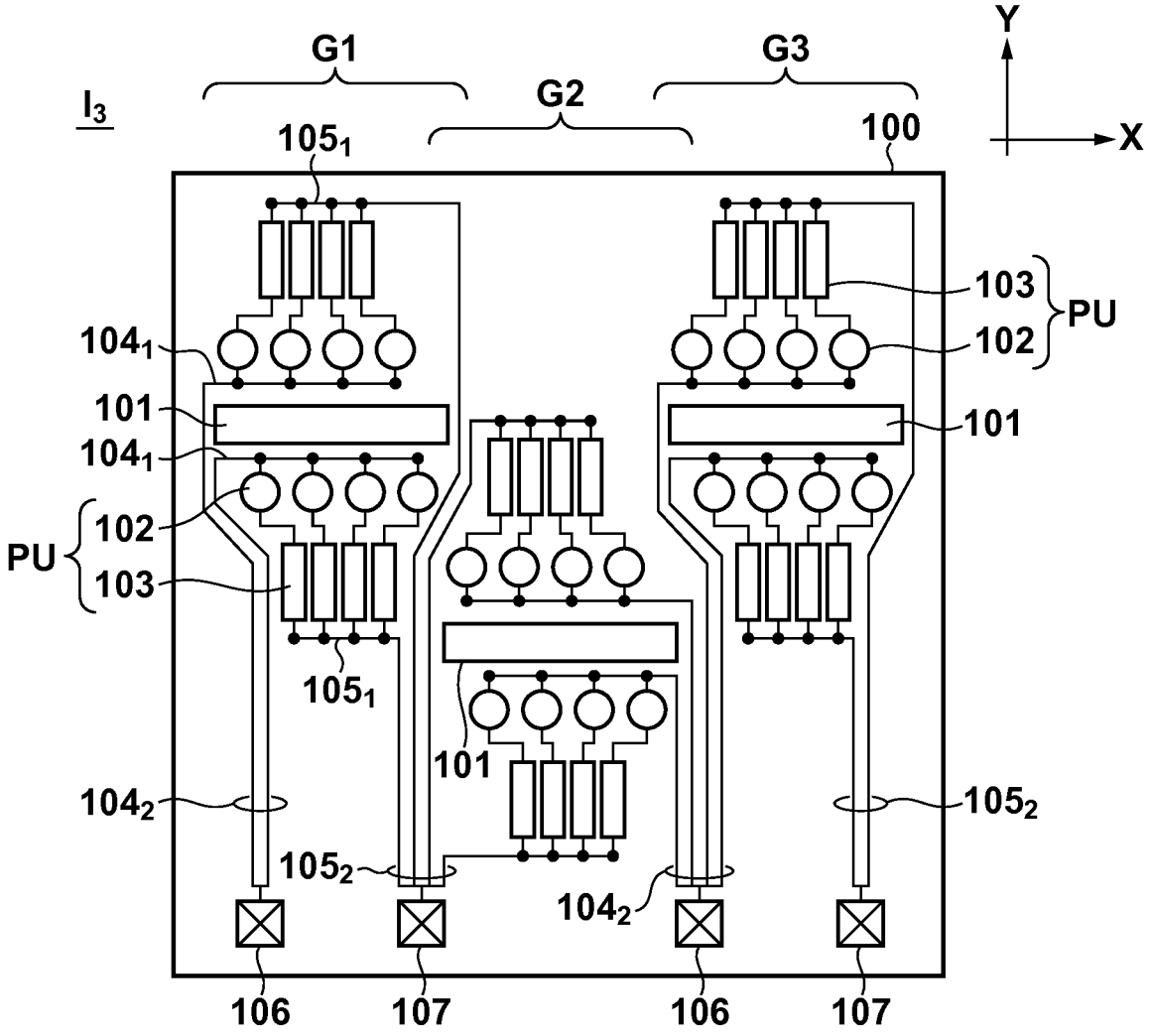
FIG. 7 is a diagram for explaining an example of the arrangement of a printhead substrate.
Figure 8:
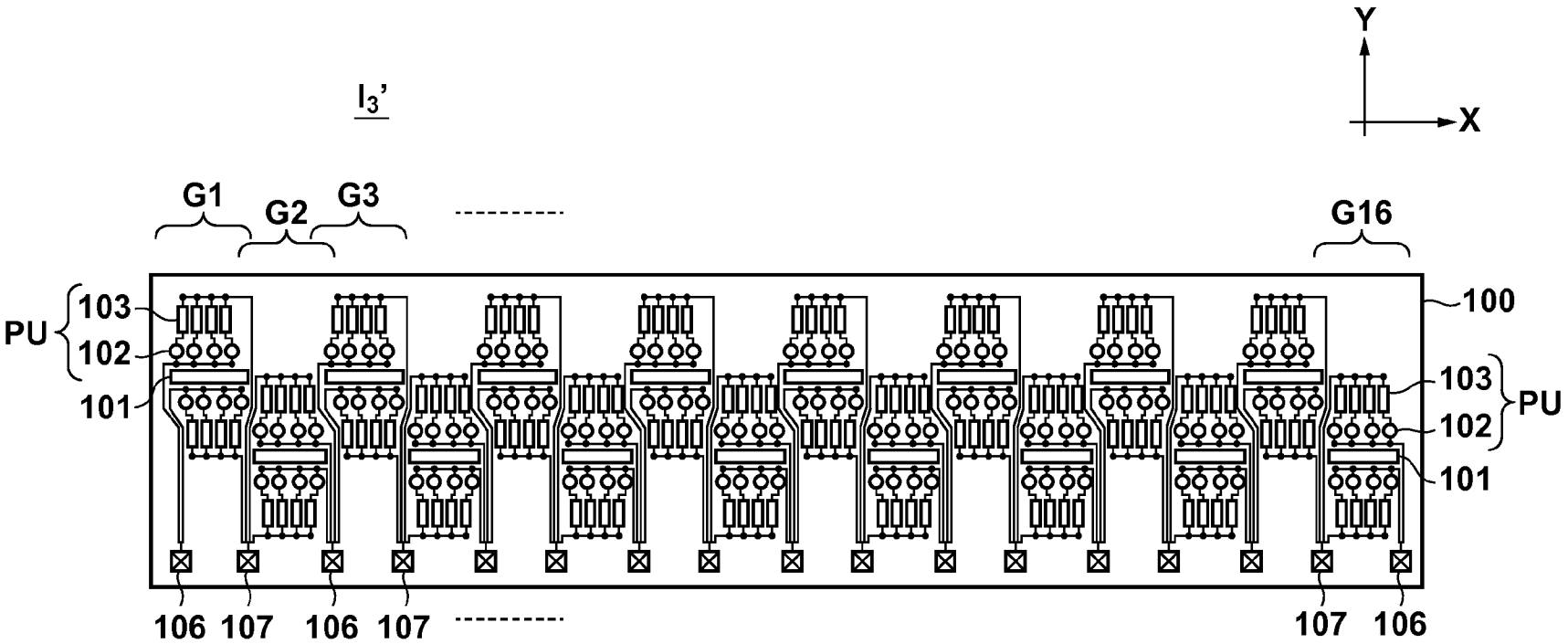
FIG. 8 is a diagram for explaining an example of the arrangement of the printhead substrate.

The third embodiment will be described with reference to FIGS. 7 and 8. FIG. 7 is a schematic diagram showing an example of the arrangement of a printhead substrate $I_3$ according to this embodiment. This embodiment is different from the aforementioned second embodiment in that a plurality of printing portions PU are arranged in a staggered manner for each group G along an X direction, and form a staggered arrangement on the group basis. According to this arrangement, the printhead substrate $I_3$ can have a rectangular shape. Likewise, an ink supply portion 101 corresponding to each group G is formed in the staggered manner.

This embodiment and the aforementioned second embodiment are the same in that the groups G and the ink supply portions 101 shift in a Y direction for each group G. Accordingly, it is possible to make a spacing of the printing portions PU between the adjacent groups G in the X direction smaller than that in the first embodiment while arranging wiring patterns $\mathbf{104}_2$ and $\mathbf{105}_2$ to pass through between the respective ink supply portions 101. This makes it possible to, when printing, form dots on a printing medium so as not to form spaces resulting from distances between the respective groups G. In addition, it is possible to arrange the wiring patterns $\mathbf{104}_2$ and $\mathbf{105}_2$ between two adjacent ink supply portions 101.

Also, in the adoption of the above-described arrangement, a part of two ink supply portions 101 corresponding to a portion between the adjacent groups G may be formed to overlap with each other when viewed from above with respect to the Y direction. According to this arrangement, it is possible to uniformize ink supply amounts to the individual printing portions PU in the respective groups G, and also supply sufficient ink to the printing portion PU at the edge of each group G.

As shown in FIG. 7, an array spacing between driving elements 103 may become smaller than that between printing elements 102. This arrangement can ensure a region to arrange the wiring patterns $\mathbf{104}_2$ and $\mathbf{105}_2$, and is also advantageous from the viewpoint of the layout.

According to the above arrangement, the same effect as in the first and second embodiments is obtained. Note that although the description has been made above using the arrangement including three groups G1 to G3, the number of groups G may be four or more. For example, when more printing portions PU are formed on a substrate 100 to increase the printing speed, the number of groups G may further be increased. FIG. 8 shows an example of the arrangement of a printhead substrate $I_3'$ including 16 groups G1 to G16. The plurality of printing portions PU on the printhead substrate $I_3'$ are arranged in the staggered manner for each group G along the X direction, and form the staggered arrangement on the group basis. In this manner, it is possible to restrict the number of printing portions PU per one group G to a predetermined number or less by increasing the number of groups G when increasing the number of printing portions PU. This makes it possible to suppress a drop in power supply voltage in each group G.

Fourth Embodiment

Figure 9:
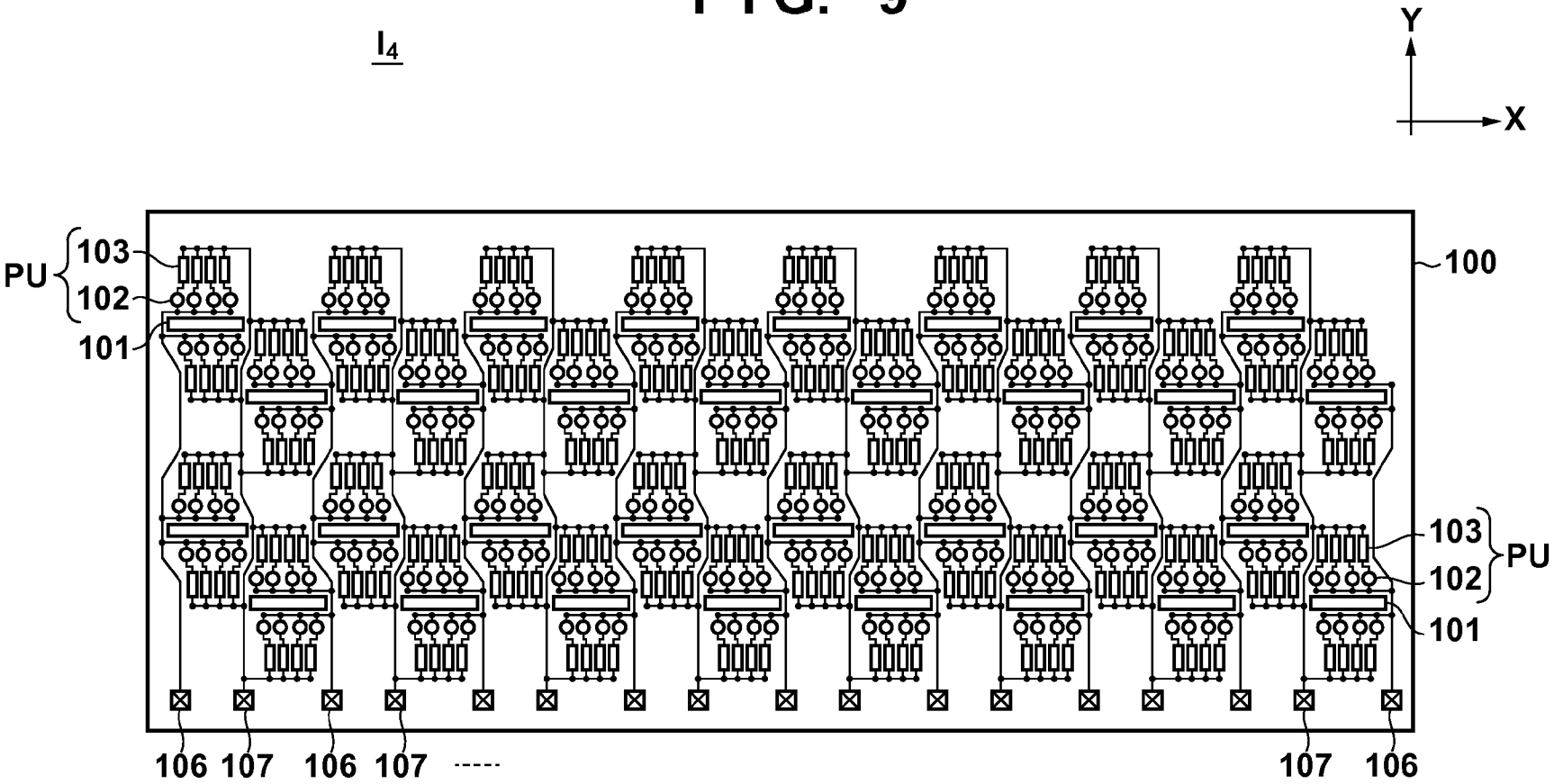
FIG. 9 is a diagram for explaining an example of the arrangement of a printhead substrate.
Figure 10:
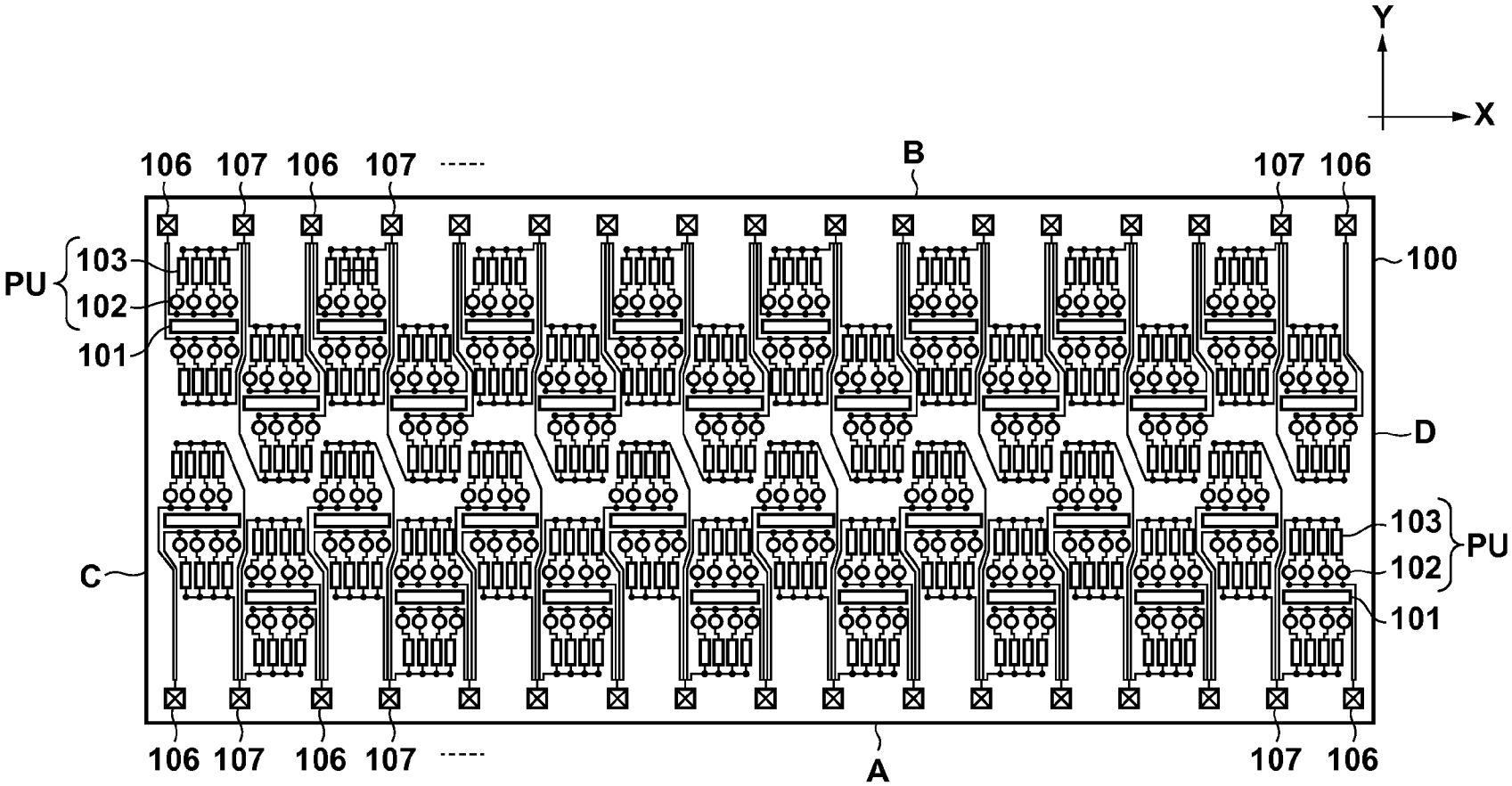
FIG. 10 is a diagram for explaining an example of the arrangement of the printhead substrate.

The fourth embodiment will be described with reference to FIGS. 9 and 10. This embodiment is different from the aforementioned third embodiment in that two staggered arrangements are formed on a group basis. FIG. 9 is a schematic diagram showing an example of the arrangement of a printhead substrate $I_4$. For example, inks having different colors can be supplied to respective printing portions PU in two staggered arrangements. That is, this embodiment is also applicable to a printhead substrate compatible with color printing. When using more inks having different colors, the number of columns in the staggered arrangements may be three or more. According to this arrangement, the same effects as in the first to the third embodiments are also obtained in the printhead substrate compatible with color printing.

When ink having a single color is supplied to both the printing portions PU in two staggered arrangements, the two staggered arrangements may be formed to shift from each other in an X direction. That is, letting P be an array spacing between the printing portions PU (a pitch between the printing portions PU in the X direction), one of two staggered arrangements can be arranged to shift from the other by a P/4-distance. According to this arrangement, in a printing operation, the two staggered arrangements are formed to shift from each other, thereby forming dots on a printing medium with a P/4-pitch. In addition to the same effects as in the first to the third embodiments, this arrangement is advantageous in further improving the quality of a printing product.

The arrangement in which each of pads 106 and 107 is only arranged in the vicinity of a side A has been exemplified above. However, the pads 106 and 107 may be arranged, in correspondence with the respective two staggered arrangements, in the vicinities of the side A and a side B respectively. More specifically, as exemplified in FIG. 10, the pads 106 and 107 may be arranged in the vicinity of the side A for one of two staggered arrangements, and the pads 106 and 107 may be arranged in the vicinity of the side B for the other.

Others

The configuration of an inkjet printing method of printing by applying ink as a printing material onto a printing medium has been exemplified above. However, the present invention is not limited to this mode. The present invention may appropriately modify a part of the present invention and combine the above-described embodiments, without departing from the scope of the present invention.

"Printing" can include, in addition to printing which forms significant information such as characters and graphics, printing in a broad sense regardless of whether it is significant or insignificant. For example, "printing" may not be so visualized as to be visually perceivable by humans, and can also include printing which forms images, figures, patterns, structures, and the like on the printing medium, or printing which processes the medium.

The "printing material" can include not only the "ink" used in the above-described embodiments but also consumables used for printing. The "printing material" can include, for example, not only a material used for forming the images, the figures, the patterns, and the like when applied onto the printing medium but also a liquid used for printing medium processing or ink processing (for example, solidification or insolubilization of a coloring material contained in the ink to be applied to the printing medium).

Also, the "printing medium" can include not only paper used in general printing apparatuses, but also materials capable of accepting printing materials, such as cloth, a plastic film, a metal plate, glass, ceramics, resin, wood, and leather.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-237356, filed Nov. 15, 2013, which is hereby incorporated by reference herein in its entirety.

What is claimed is:

1. A printhead substrate comprising:

a plurality of printing portions;

a plurality of ink supply ports;

wherein the plurality of printing portions are divided into a plurality of groups arrayed along a first direction, and wherein the plurality of ink supply ports are arranged along the first direction so as to correspond to the plurality of groups respectively; and a plurality of first voltage wiring portions, provided in correspondence with the plurality of groups, each of which is configured to supply a first voltage to a first terminal of each printing portion in the corresponding groups; and a plurality of second voltage wiring portions, provided in correspondence with the plurality of groups, each of which is configured to supply a second voltage to a second terminal of each printing portion in the corresponding group, wherein each of the plurality of first voltage wiring portions includes:

a first wiring pattern configured to electrically connect the first terminals of the printing portions in the corresponding group with each other, and a second wiring pattern arranged between an ink supply port in the corresponding group and another ink supply port different from the ink supply port in the corresponding group, and electrically connected to the first wiring pattern, and wherein each of the plurality of second voltage wiring portions includes:

a third wiring pattern configured to electrically connect the second terminals of the printing portions in the corresponding group with each other, and a fourth wiring pattern arranged between the ink supply port in the corresponding group and another ink supply port different from the ink supply port in the corresponding group, and electrically connected to the third wiring pattern.

2. The substrate according to claim 1, wherein the first wiring pattern is arranged along the first direction, and the second wiring pattern is arranged along a second direction intersecting the first direction.

3. The substrate according to claim 2, wherein the printhead substrate includes a first side along the first direction and a second side along the second direction which is shorter than the first side, the printhead substrate further comprises a plurality of pads arranged along the first side, and the second wiring pattern in each of the first voltage wiring portions electrically connects the first wiring pattern and one of the plurality of pads.

4. The substrate according to claim 3, wherein the fourth wiring pattern in each of the second voltage wiring portions electrically connects the third wiring pattern and another one of the plurality of pads.

5. The substrate according to claim 1, wherein, in each of the plurality of groups, the printing portions are arrayed to form two columns, the two columns neighboring in a second direction intersecting the first direction and each being formed along the first direction, and the corresponding ink supply port is arranged between the two columns.

6. The substrate according to claim 5, wherein letting P be a pitch in the first direction of the printing portions arrayed in the respective two columns, one of the two columns is arranged to shift from the other of the two columns by a P/2-distance in the first direction.

7. The substrate according to claim 1, wherein the plurality of groups include a first group and a second group adjacent to each other, and the printing portion in the first group and the printing portion in the second group are arranged to shift from each other in a second direction intersecting the first direction.

8. The substrate according to claim 7, wherein a part of an ink supply port corresponding to the first group and a part of an ink supply port corresponding to the second group overlap when viewed from above with respect to the second direction.

9. The substrate according to claim 1, wherein the plurality of groups are arranged in a staggered manner along the first direction.

10. The substrate according to claim 9, wherein a part of an ink supply port corresponding to each group and a part of an ink supply port corresponding to another group adjacent to the group overlap when viewed from above with respect to a second direction intersecting the first direction.

11. The substrate according to claim 1, wherein the plurality of ink supply ports are arranged with being divided into a plurality of columns each along the first direction.

12. The substrate according to claim 1, wherein each of the plurality of printing portions includes a printing element and a driving element configured to drive the printing element.

13. The substrate according to claim 1, wherein each of the plurality of printing portions includes a printing element and a driving element configured to drive the printing element, and in the first direction, a pitch between the adjacent driving elements is smaller than that between the adjacent printing elements.

14. A printhead comprising:

a printhead substrate; and an ink orifice provided in correspondence with each printing element on the printhead substrate and configured to discharge ink in response to driving of the printing element, wherein the printhead substrate includes:

a plurality of printing portions;

a plurality of ink supply ports, each of the plurality of printing portions including a printing element and a driving element configured to drive the printing element, wherein the plurality of printing portions are divided into a plurality of groups arrayed along a first direction, and wherein the plurality of ink supply ports are arranged along the first direction so as to correspond to the plurality of groups respectively;

a plurality of first voltage wiring portions, provided in correspondence with the plurality of groups, each of which is configured to supply a first voltage to a first terminal of each printing portion in the corresponding group; and a plurality of second voltage wiring portions, provided in correspondence with the plurality of groups, each of which is configured to supply a second voltage to a second terminal of each printing portion in the corresponding group, wherein each of the plurality of first voltage wiring portions includes:

a first wiring pattern configured to electrically connect the first terminals of the printing portions in the corresponding group with each other, and a second wiring pattern arranged between an ink supply port in the corresponding group and another ink supply port different from the ink supply port in the corresponding group, and electrically connected to the first wiring pattern, and wherein each of the plurality of second voltage wiring portions includes:

a third wiring pattern configured to electrically connect the second terminals of the printing portions in the corresponding group with each other, and a fourth wiring pattern arranged between the ink supply port in the corresponding group and another ink supply port different from the ink supply port in the corresponding group, and electrically connected to the third wiring pattern.

15. A printing apparatus comprising:

a printhead; and a printhead driver configured to drive the printhead, wherein the printhead comprises:

a printhead substrate, and an ink orifice provided in correspondence with each printing element on the printhead substrate and configured to discharge ink in response to driving of the printing element, wherein the printhead substrate includes:

a plurality of printing portions;

a plurality of ink supply ports, each of the plurality of printing portions including a printing element and a driving element configured to drive the printing element, wherein the plurality of printing portions are divided into a plurality of groups arrayed along a first direction, and wherein the plurality of ink supply ports are arranged along the first direction so as to correspond to the plurality of groups respectively;

a plurality of first voltage wiring portions, provided in correspondence with the plurality of groups, each of which is configured to supply a first voltage to a first terminal of each printing portion in the corresponding group; and a plurality of second voltage wiring portions, provided in correspondence with the plurality of groups, each of which is configured to supply a second voltage to a second terminal of each printing portion in the corresponding group, wherein each of the plurality of first voltage wiring portions includes:

a first wiring pattern configured to electrically connect the first terminals of the printing portions in the corresponding group with each other, and a second wiring pattern arranged between an ink supply port in the corresponding group and another ink supply port different from the ink supply port in the corresponding group, and electrically connected to the first wiring pattern, and wherein each of the plurality of second voltage wiring portions includes:

a third wiring pattern configured to electrically connect the second terminals of the printing portions in the corresponding group with each other, and a fourth wiring pattern arranged between the ink supply port in the corresponding group and another ink supply port different from the ink supply port in the corresponding group, and electrically connected to the third wiring pattern.

16. The substrate according to claim 10, further comprising a plurality of pads arranged along a first side along the first direction, wherein the plurality of pads are arranged, when viewed from above with respect to the second direction, such that one of a pad receiving the first voltage and a pad receiving the second voltage locates at each position between two neighboring groups among the plurality of groups and such that the pad receiving the first voltage and the pad receiving the second voltage are alternately provided.

17. The substrate according to claim 10, further comprising a plurality of pads arranged along a first side along the first direction, wherein the plurality of groups, arranged in the staggered manner, include:

a first group which is closer to a third side, which is opposite to the first side, than to the first side, a second group which neighbors the first group and is closer to the first side than the third side, and a third group which neighbors the second group at a side opposite to the first group and is closer to the third side than the first side, wherein the plurality of pads include, when viewed from above with respect to the second direction, a first pad provided between the first group and the second group and a second pad provided between the second group and the third group, wherein one of the second wiring pattern and the fourth wiring pattern corresponding to the first group and one of the second wiring pattern and the fourth wiring pattern corresponding to the second group, which is to be connected to the one corresponding to the first group, are connected to the first pad, and wherein the other of the second wiring pattern and the fourth wiring pattern corresponding to the third group and the other of the second wiring pattern and the fourth wiring pattern corresponding to the second group are connected to the second pad.

18. The substrate according to claim 17, wherein, for each of the first group, the second group and the third groups, the corresponding printing portions are arrayed along the first direction to form two rows, wherein the corresponding ink supply port locates between the two rows, wherein the one of the second wiring pattern and the fourth wiring pattern corresponding to the first group, electrically connected to the first pad, includes part which is extended along a third direction intersecting with each of the first direction and the second direction so as to pass between the ink supply port of the first group and the ink supply port of the second group, and wherein the other of the second wiring pattern and the fourth wiring pattern corresponding to the third group, electrically connected to the second pad, includes part which is extended along a fourth direction intersecting with each of the first direction, the second direction and the third direction so as to pass between the ink supply port of the second group and the ink supply port of the third group.

19. The substrate according to claim 18, wherein the one of the second wiring pattern and the fourth wiring pattern corresponding to the first group and the one of the second wiring pattern and the fourth wiring pattern corresponding to the second group are connected to each other at a position between the first pad and each printing portion in the second group when viewed from above with respect to the first direction, and wherein the other of the second wiring pattern and the fourth wiring pattern corresponding to the third group and the other of the second wiring pattern and the fourth wiring pattern corresponding to the second group are connected to each other at a position between the second pad and each printing portion in the second group when viewed from above with respect to the first direction.

* * * * *